US007073419B2

(12) United States Patent
Weber

(10) Patent No.: US 7,073,419 B2
(45) Date of Patent: Jul. 11, 2006

(54) POSITIONING METHOD AND DEVICE

(75) Inventor: Günther Weber, Zachow (DE)

(73) Assignee: Weber MaschinenbauGmbH & Co. KG, Breidenbach (DE)

( * ) Notice: Subject to any disclaimer, the term of this patent is extended or adjusted under 35 U.S.C. 154(b) by 85 days.

(21) Appl. No.: 10/489,753

(22) PCT Filed: Sep. 5, 2002

(86) PCT No.: PCT/EP02/09955

§ 371 (c)(1),
(2), (4) Date: Apr. 28, 2004

(87) PCT Pub. No.: WO03/024675

PCT Pub. Date: Mar. 27, 2003

(65) Prior Publication Data

US 2004/0211302 A1 Oct. 28, 2004

(30) Foreign Application Priority Data

Sep. 19, 2001 (DE) ..... 101 46 155

(51) Int. Cl.
*B26D 7/08* (2006.01)

(52) U.S. Cl. ..... 83/14; 83/468.2; 83/932

(58) Field of Classification Search ..... 83/932, 83/14, 208, 703, 468.2, 438
See application file for complete search history.

(56) References Cited

U.S. PATENT DOCUMENTS

| | | | | |
|---|---|---|---|---|
| 4,217,650 | A | 8/1980 | Kuchler | 364/567 |
| 4,913,019 | A * | 4/1990 | Hayashi | 83/367 |
| 5,481,466 | A * | 1/1996 | Carey | 700/167 |
| 5,724,874 | A * | 3/1998 | Lindee et al. | 83/27 |
| 5,787,776 | A * | 8/1998 | Nishimoto | 83/76.7 |
| 5,974,925 | A * | 11/1999 | Lindee et al. | 83/412 |
| 6,418,823 | B1 * | 7/2002 | Taitler | 83/36 |
| 2002/0059858 | A1 * | 5/2002 | Lindee | 83/676 |

FOREIGN PATENT DOCUMENTS

| | | |
|---|---|---|
| DE | 695 16 809 T2 | 5/1996 |
| DE | 196 04 254 A1 | 8/1997 |
| DE | 198 20 058 | 12/1999 |
| DE | 198 37 645 | 2/2000 |
| DE | 100 01 338 A1 | 8/2001 |
| WO | 98/35796 | 8/1998 |
| WO | 00/74492 | 12/2000 |

* cited by examiner

*Primary Examiner*—Charles Goodman
(74) *Attorney, Agent, or Firm*—Gifford, Krass, Groh, Sprinkle, Anderson & Citkowski, P.C.

(57) ABSTRACT

A method and apparatus for slicing a food product. The food product is moved in a conveying direction toward a rotary cutter driven in a cutting plane. A sensor detects the width of the food product and provides an output to an adjustment circuit which moves the food product in a direction transverse to the conveying direction.

12 Claims, 1 Drawing Sheet

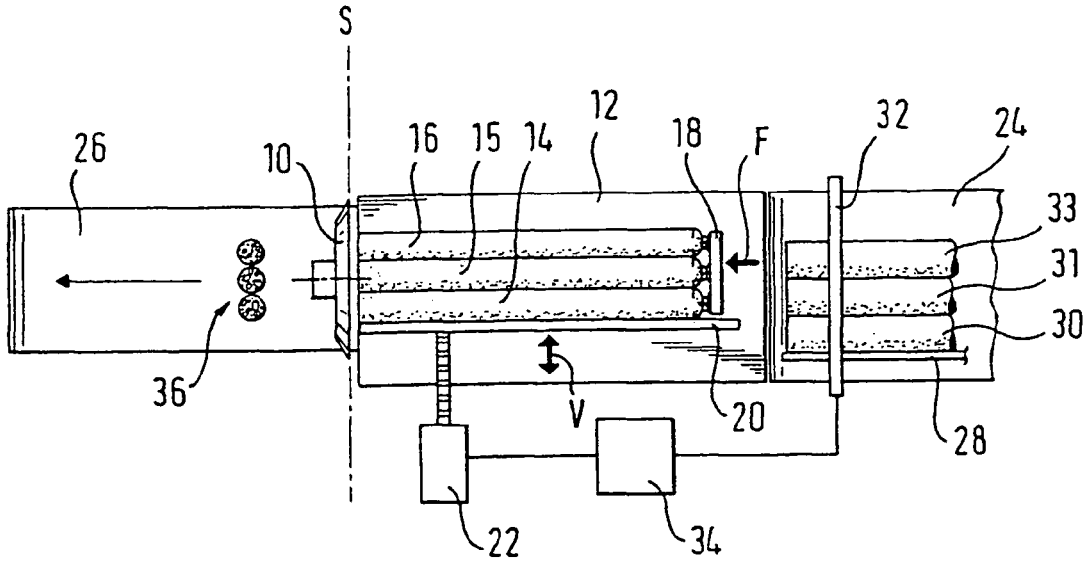
S
26
10
16
15
14
12
18
F
32
24
33
31
30
36
V
20
28
22
34

POSITIONING METHOD AND DEVICE

BACKGROUND OF THE INVENTION

1. Field of the Invention

The present invention relates to a method for the positioning of a food product on an automated cutting apparatus for the cutting of food products. Such automated cutting apparatuses are known as so-called high-performance slicers and have a blade rotatably drivable in a cutting plane and a product support on which a product to be cut is moved in the direction of the cutting plane (conveying direction). The product can be an individual product or a plurality of products arranged side by side.

2. Description of Related Art

In conventional cutting methods, the products contact a defined surface, for example, a side abutment, during cutting. With products of different widths, this has the consequence that the side positions of the products not contacting the side abutment vary when the product width fluctuates. The products hereby do not always lie aligned with respect to the position of the blade, on the one hand. The cut product slices come to lie at different side placement positions, on the other hand.

BRIEF SUMMARY OF THE INVENTION

It is the object of the present invention to provide a method and an apparatus with whose help a uniform product placement is ensured in a simple manner.

This object is satisfied by the features of the independent claims.

In accordance with the invention, the width of the product is determined by a sensor prior to cutting and the product is subsequently moved transversely to the conveying direction by an adjustment device in order to bring the product into a desired position relative to the blade. An individual product or a product group can be oriented transversely to the conveying direction by the adjustment device by the method in accordance with the invention such that a specific, desired alignment, for example a central alignment, is always ensured. The cut off product slices hereby always come to lie at a desired position on an outfeed belt subsequent to the blade, which facilitates the following further processing. It is ensured at the same time that the product or the products are supplied centrally to the blade, whereby the cutting process is made more homogeneous.

Advantageous embodiments of the invention are described in the description, in the drawing and in the dependent claims.

In accordance with an embodiment of the invention, the width of the product is determined in the region of a product supply arrangement in which the product is made available for transfer to the product support. It is ensured in this embodiment that the product width is already determined prior to the transfer of the products to the product support, such that the adjustment device can be set to the desired position before the products are transferred from the product supply arrangement to the product support.

In accordance with the invention, when cutting a plurality of products lying next to one another, either the total width of all individual products lying next to one another can be determined. Alternatively to this, it is also possible to determine the width of every individual product and to add up these determined widths to bring the adjustment device into the desired position.

The product is preferably aligned centrally with respect to the blade by the adjustment device after the determination of the product width such that the cut product slices can always be placed at a desired position on a following outfeed belt with optimum cutting quality.

An electrical or an optoelectrical sensor can be used to determine the product width. In accordance with an advantageous embodiment, a scanner device is used with whose help every individual product or the total width of all products arranged next to one another can be determined. Generally, however, the sensor can be made in any desired manner, for example as a video camera, an ultrasonic sensor or the like.

The method in accordance with the invention is suitable in the same manner for products arranged next to one another and also for individual products. In the event of cutting an individual product, it is ensured in accordance with the invention that the product slices always come to a placement at a desired position on the outfeed belt.

The present invention will be described in the following purely by way of example with reference to an advantageous embodiment and to the enclosed drawing.

BRIEF DESCRIPTION OF THE DRAWING

The only FIGURE shows a schematic plan view of a cutting apparatus for the cutting of food products.

DETAILED DESCRIPTION OF THE INVENTION

The FIGURE shows an apparatus for the positioning of a food product on an automated cutting apparatus for the cutting of food products, with the cutting apparatus having a blade 10 rotatably drivable in a cutting plane S and a product support 12 on which the product or the products to be cut are moved in the direction of the cutting plane S. This direction of movement (conveying direction) is indicated by the arrow F.

In the embodiment shown, a total of three product loaves 14, 15, 16 are arranged on the product support 12 and are moved in the direction of the cutting plane S by a product supply arrangement 18. The three products 14, 15, 16 are arranged side by side next to one another and contact a side abutment 20.

The side abutment 20 is adjustable in a direction V transversely to the conveying direction F, and indeed with the help of an electrical adjustment device 22.

An infeed belt 24 which is likewise movable in the conveying direction F is provided in front of the product support 12 in the conveying direction. An outfeed belt 26 which is likewise movable in the conveying direction F is provided after the product support 12 in the conveying direction.

A stationary abutment 28 which the following products 30, 31, 33 contact is provided in the region of the infeed belt 24. A sensor 32 is provided above the infeed belt 24 in the form of a scanner with whose aid the width of the individual products 30, 31, 33, or alternatively the total width of the products 30, 31 and 33 lying next to one another, can be determined. The sensor 32 is connected to a control device 34 which in turn controls the electrical adjustment device 22 to adjust the side abutment 20.

In the method in accordance with the invention, the width of the products arranged next to one another is determined with the help of the sensor 32 in the region of the infeed belt 24, whereupon the electrical adjustment device 22 can be controlled with the help of the control 34 such that the products adopt a desired position relative to the blade on the product supply arrangement.

After the products 14, 15 and 16 have been completely cut up, the adjustable side abutment 20 is first moved into the most extreme left hand position (considered in the conveying direction) with the help of the adjustment apparatus 22 such that the succeeding products 30, 31, 33 can be transferred to the product support 12. Since the width of the products 30, 31, 33 has previously been determined with the help of the sensor 32, the side abutment 20 can subsequently be moved with the help of the adjustment device 22 such that the products 30 and 31, 33 come to rest at the desired position transversely to the conveying direction F and relative to the blade 10.

In accordance with a variant of the invention, a temperature feeler can additionally be provided which detects the temperature of the product and/or the ambient temperature and which is connected to the control 34. In this case, the transverse displacement of the product can take place in dependence on the detected temperature, whereby a desired ejection position of the cut slices can be achieved in an even better fashion, since this is temperature dependent.

REFERENCE NUMERAL LIST

10 blade
12 product support
14, 15, 16 products
18 product supply arrangement
20 side abutment
22 adjustment device
24 infeed belt
26 outfeed belt
28 abutment
30, 31, 33 products
32 sensor
34 control
36 product slices
F conveying direction
S cutting plane
V adjustment direction

The invention claimed is:

1. A method for the positioning of a food product on an automated cutting apparatus for the cutting of food products, with the cutting apparatus having a blade rotatably drivable in a cutting plane and a product support on which at least one product to be cut is moved in the direction of the cutting plane (conveying direction), in which method the width of the product is determined by a sensor prior to cutting and the product is subsequently moved transversely to the conveying direction by an adjustment device in order to bring the product into a desired position relative to the blade in dependence on the value measured.

2. A method in accordance with claim 1, characterized in that the width of the product is determined in the region of a product supply arrangement in which the product is made available for transfer to the product support.

3. A method in accordance with claim 1, characterized in that a plurality of individual products lying next to one another and contacting one another are cut and in that the width of every individual product is determined.

4. A method in accordance with claim 1, characterized in that a plurality of individual products lying next to one another and contacting one another are cut and in that the total width of all individual products lying next to one another is determined.

5. A method in accordance with claim 1, characterized in that a side abutment is used as the adjustment device.

6. A method in accordance with claim 1, characterized in that the blade runs around a cutter head on cutting and in that the product is aligned centrally with respect to the cutter head by the adjustment device.

7. A method in accordance with claim 1, characterized in that an electrical or an optoelectrical sensor is used to determine the product width.

8. A method in accordance with claim 1, characterized in that the temperature of the product and/or the ambient temperature is measured and in that the product is also brought into a desired position relative to the blade in dependence on the temperature value measured.

9. An apparatus for the positioning of a food product on an automated cutting apparatus for the cutting of food products, in particular for the carrying out of the method of claim 1, wherein the cutting apparatus has a blade (10) rotatably drivable in a cutting plane (S) and a product support (12) on which at least one product (14–16) to be cut is moved in the direction of the cutting plane (S) (conveying direction F), comprising:

a sensor (32) for determining the product width;

a driven adjustment device (20, 22) with which the product is movable transversely to the conveying direction (F); and a control device (34) which controls the adjustment device in dependence on the product width determined by the sensor (32) to bring the product into a desired position relative to the blade (12).

10. An apparatus in accordance with claim 9, characterized in that the sensor (18) is an optoelectrical sensor.

11. An apparatus in accordance with claim 9, characterized in that the adjustment device is an electrically adjustable side abutment (20) which the product contacts during cutting.

12. An apparatus in accordance with claim 9, characterized in that the product support is adjustable transversely to the conveying direction by the adjustment device.

* * * * *